US008491341B2

(12) United States Patent
Bower et al.

(10) Patent No.: US 8,491,341 B2
(45) Date of Patent: Jul. 23, 2013

(54) UNIVERSAL BATTERY CONNECTOR

(75) Inventors: Clinton R. Bower, Post Falls, ID (US); David H. Kouche, Hayden Lake, ID (US); Christian P. Nicastro, Post Falls, ID (US); Alex B. Worsfold, Post Falls, ID (US)

(73) Assignee: Vertical Partners West, LLC, Rathdrum, ID (US)

( * ) Notice: Subject to any disclaimer, the term of this patent is extended or adjusted under 35 U.S.C. 154(b) by 611 days.

(21) Appl. No.: 12/496,292

(22) Filed: Jul. 1, 2009

(65) Prior Publication Data

US 2011/0003512 A1 Jan. 6, 2011

(51) Int. Cl.
*H01R 25/00* (2006.01)

(52) U.S. Cl.
USPC ..... 439/638; 439/686

(58) Field of Classification Search
USPC ..... 439/686, 680, 638, 639, 217, 218, 439/166, 956, 627
See application file for complete search history.

(56) References Cited

U.S. PATENT DOCUMENTS

| | | | | |
|---|---|---|---|---|
| 3,794,957 | A | 2/1974 | Winkler | |
| 4,990,099 | A * | 2/1991 | Marin et al. | 439/284 |
| 5,104,344 | A | 4/1992 | Jansco, Jr. | |
| 5,161,990 | A | 11/1992 | Ling et al. | |
| 5,533,915 | A | 7/1996 | Deans | |
| 5,720,628 | A * | 2/1998 | Usui et al. | 439/502 |
| 6,236,181 | B1 | 5/2001 | Baan | |
| 6,358,096 | B1 | 3/2002 | Beckman | |
| 6,454,584 | B1 * | 9/2002 | Milan | 439/214 |
| 6,638,086 | B2 | 10/2003 | Lavender et al. | |
| 6,843,689 | B2 * | 1/2005 | Coniff | 439/638 |
| 6,935,877 | B2 | 8/2005 | Liao | |
| 7,035,126 | B1 * | 4/2006 | Lanni | 363/142 |
| 7,038,463 | B2 | 5/2006 | Cooper et al. | |
| 7,175,474 | B1 * | 2/2007 | Chang et al. | 439/501 |
| 7,241,169 | B1 * | 7/2007 | Yang | 439/518 |
| 7,374,460 | B1 | 5/2008 | Hariharesan et al. | |
| D573,536 | S | 7/2008 | Hariharesan et al. | |
| D576,557 | S | 9/2008 | Hariharesan et al. | |
| 7,488,204 | B2 * | 2/2009 | Hsu | 439/535 |
| 2002/0137382 | A1 | 9/2002 | Shirakura et al. | |
| 2003/0036312 | A1 * | 2/2003 | Liao | 439/638 |
| 2007/0178756 | A1 * | 8/2007 | Schriefer et al. | 439/535 |
| 2007/0281551 | A1 | 12/2007 | Butcher | |

FOREIGN PATENT DOCUMENTS

DE 19820624 A1 11/1999

OTHER PUBLICATIONS

Clarke, Brooke, "Power Pole" web page article, Ukiah, CA, 2003-2006.
Horizon Hobby, "E-flite EC3 Device & Battery Connector, Male-Female" web page, Champaign, IL, 2006.
Tyco Electronics, "Hot Plug, High Current Dual Crown Clip Socket Connector" ELCON Products International Co., Fremont, CA 2000-2001.

* cited by examiner

*Primary Examiner* — Neil Abrams
*Assistant Examiner* — Travis Chambers
(74) *Attorney, Agent, or Firm* — Kelly & Kelley, LLP

(57) ABSTRACT

A universal battery connector and system for R/C devices adaptable for use with different types of battery connection plugs. A battery and universal battery plug may be connected to either a Traxxas® or Molex® brand battery connection plug through the use of a specifically designed adaptor plug. The adaptor plug includes universal contacts for connection to a terminal on the universal battery plug. The adaptor plug also includes adaptor terminals configured for slide-fit reception of either a Traxxas® or Molex® brand battery connection plug.

18 Claims, 10 Drawing Sheets

UNIVERSAL BATTERY CONNECTOR

BACKGROUND OF THE INVENTION

This invention relates generally to battery connectors for radio controlled (R/C) devices. More specifically, this invention relates to a universal battery connector for connection to multiple different battery connection plugs, i.e., Traxxas® or Molex® brand plugs.

The radio controlled hobby market is a popular and fast growing field. One problem that has arisen in the radio controlled hobby market is the existence of several competing battery plug types that are designed so as to not be interchangeable. What this means is that a battery configured with plug type A will only work on an R/C device that accepts plug type A. A battery with plug type B will only work on an R/C device that accepts plug type B. The plug types are not interchangeable such that if a hobbyist buys multiple R/C devices, the hobbyist may very well be required to buy multiple batteries of different plug types to work with each device.

For retail hobby and toy stores this lack of interchangeability creates a situation whereby they must carry the same battery pack but in two different plug types. In essence the batteries themselves are the same but the plug types on the batteries are different. Retailers who sell and support different brands of R/C devices are forced to carry an excess of battery stock that would otherwise not be needed if plug types were interchangeable.

The present invention satisfies these needs and provides other related advantages.

SUMMARY OF THE INVENTION

The present invention resides in a universal battery connector system for radio controlled devices. The system is adaptable for use with different types of battery connection plugs having different types of electrically conductive contacts. The system comprises a universal battery plug, a first adaptor, and a second adaptor. The first and second adaptors each include adaptor terminals configured for receipt of corresponding electrically conductive contacts on different types of battery connection plugs and universal contacts configured for connection to the universal battery plug.

The first adaptor is configured for conductively coupling the universal battery plug to electrically conductive contacts on a first battery connection plug. Preferably, the first adaptor is configured for slide fit reception with the first battery connection plug, which has two electrically conductive male contacts. Specifically, the first battery connection plug is a Traxxas® brand battery connection plug.

The second adaptor is configured for conductively coupling the universal battery plug to electrically conductive contacts on a second battery connection plug. Preferably, the second adaptor is configured for slide fit reception with the second battery connection plug, which has two electrically conductive female contacts. Specifically, the second battery connection plug is a Molex® brand battery connection plug.

The system may also comprise a third adaptor configured for conductively coupling the universal battery plug to electrically conductive contacts on a third battery connection plug. The third adaptor includes adaptor terminals configured for receipt of the electrically conductive contacts and universal contacts configured for connection to the universal battery plug. The third battery connection plug is also configured for slide fit reception with the third battery connection plug, which as one electrically conductive male contact and one electrically conductive female contact.

The universal battery plug preferably comprises positive and negative universal terminals configured for connection to the universal contacts on the adaptors. The universal battery plug also includes battery contacts on the universal terminals. The battery contacts are configured to receive positive and negative battery terminals from a battery.

The adaptor terminals preferably comprise positive and negative adaptor terminals and the electrically conductive contacts preferably comprise positive and negative electrically conductive contacts. In this configuration, the positive and negative electrically conductive contacts are in electrical communication with the corresponding positive and negative adaptor terminals.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
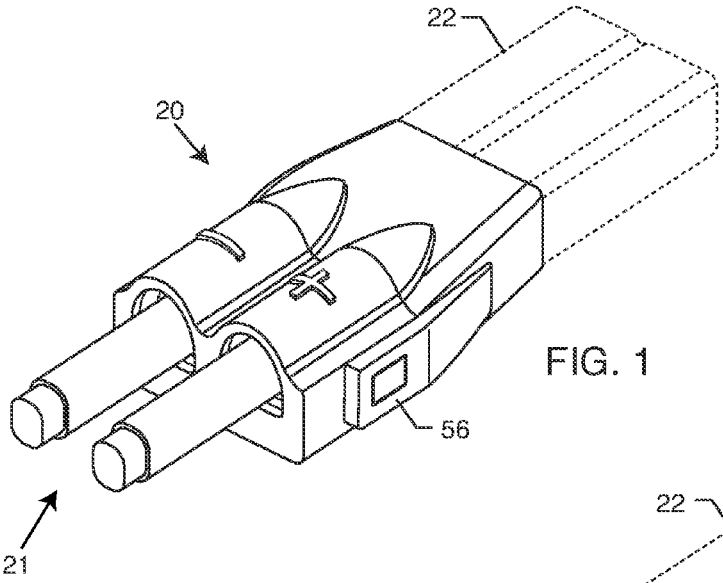
FIG. 1 illustrates a preferred embodiment of a universal battery connector of the present invention.
Figure 2:
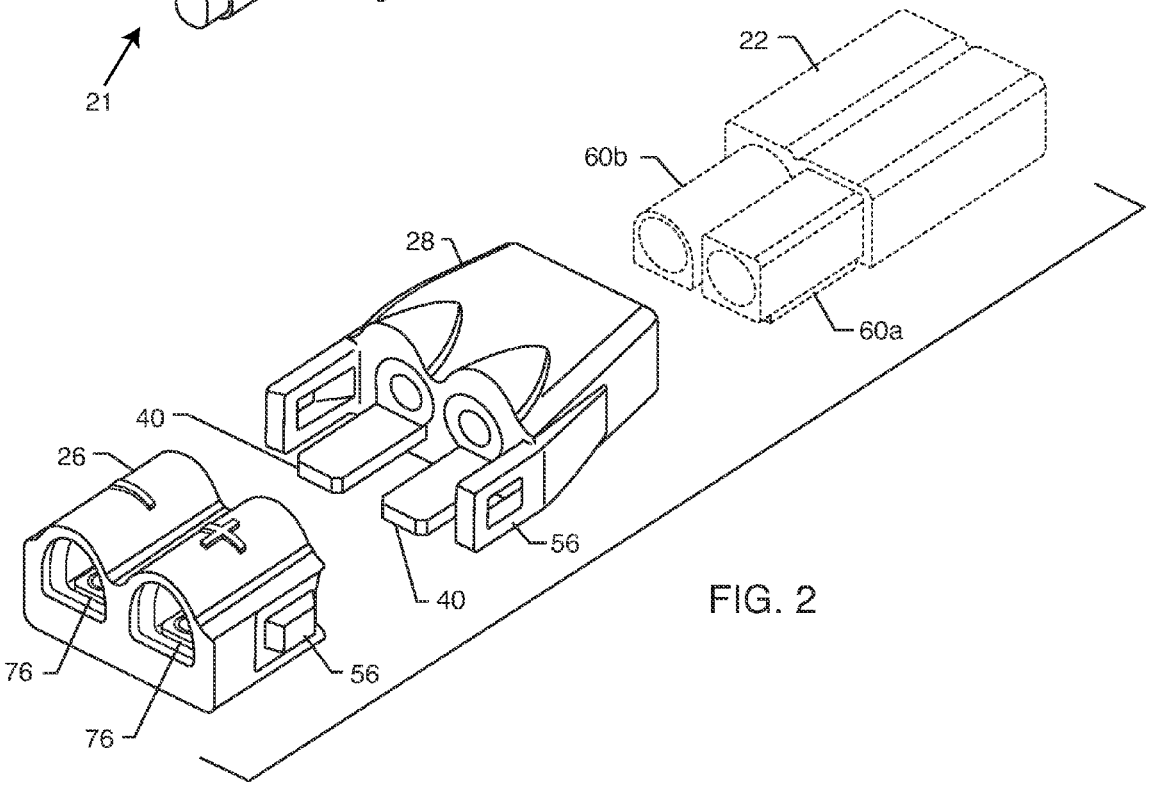
FIG. 2 illustrates an exploded view of the universal battery connector in FIG. 1.

As shown in the drawings for purposes of illustration, the present invention is concerned with a universal battery connector for connection to multiple different battery connection plugs. The universal battery connector is generally designated in the accompanying drawings by the reference numeral 20.

Figure 10:
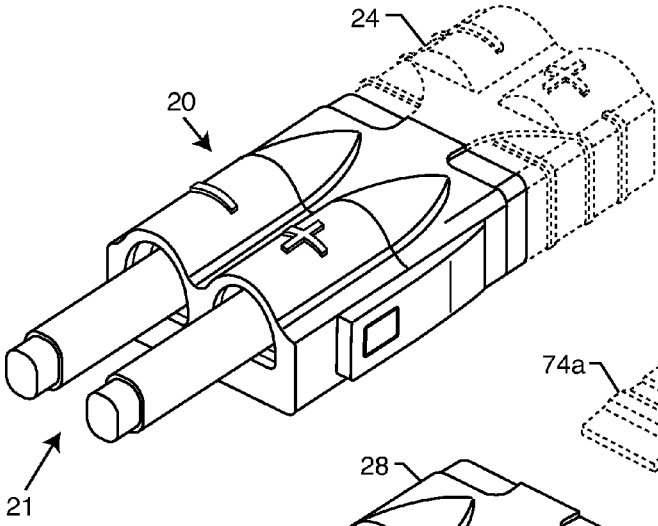
FIG. 10 illustrates another embodiment of the universal battery connector of the present invention.
Figure 11:
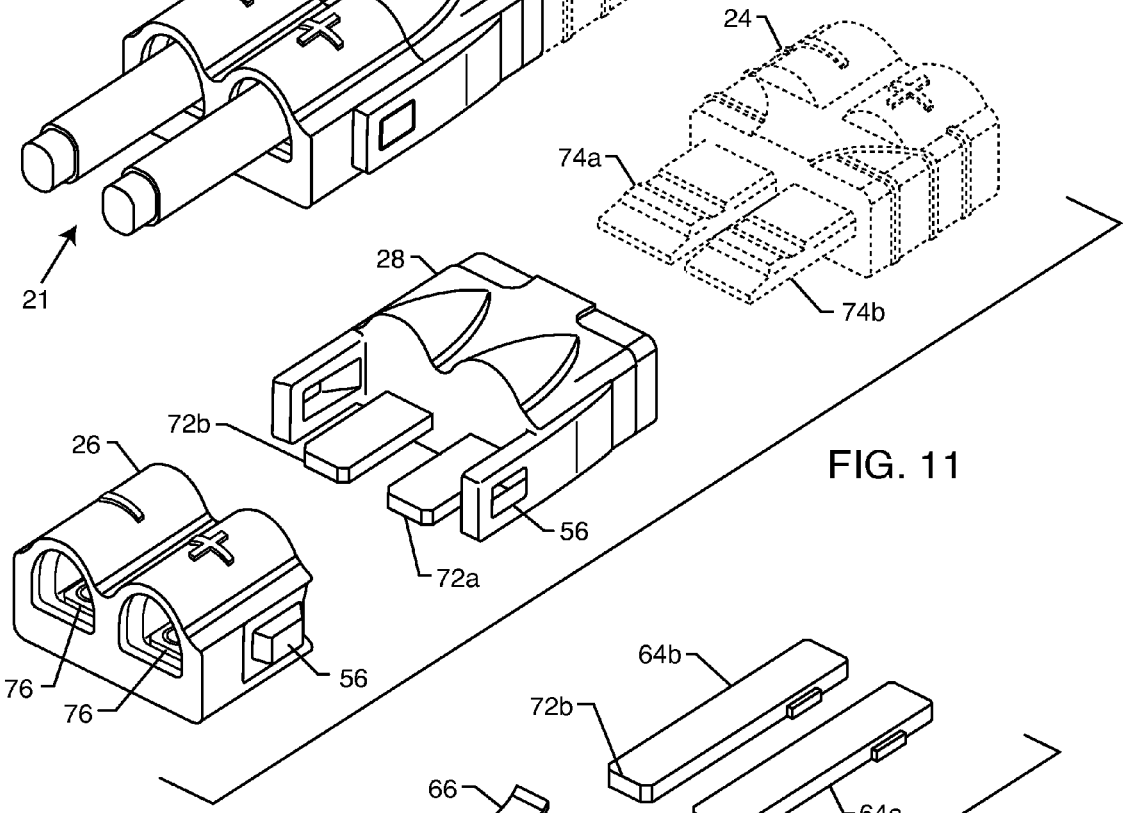
FIG. 11 illustrates an exploded view of the universal battery connector of FIG. 10.
Figure 12:
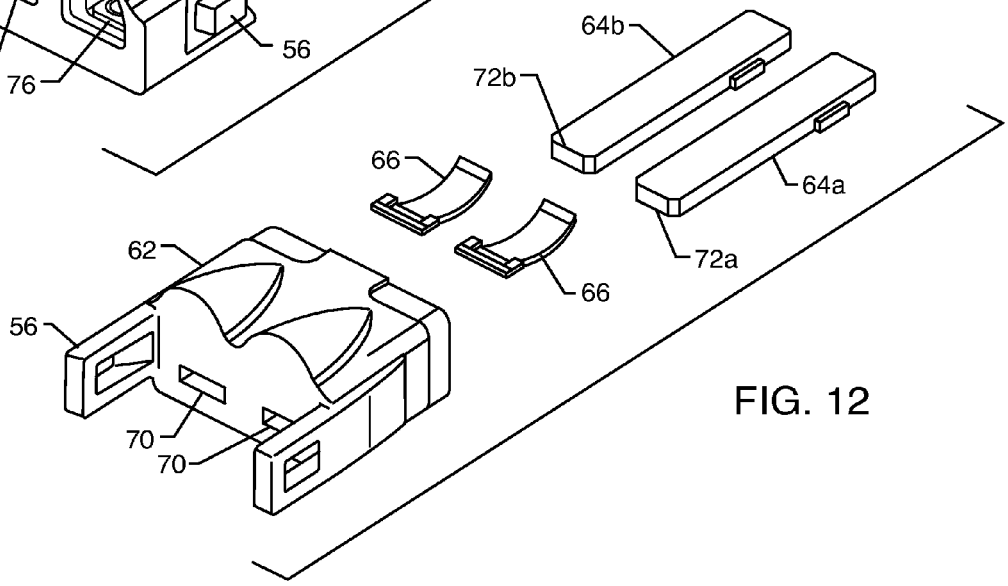
FIG. 12 illustrates an exploded view of the adaptor plug of the universal battery connector in FIG. 10.
Figure 13:
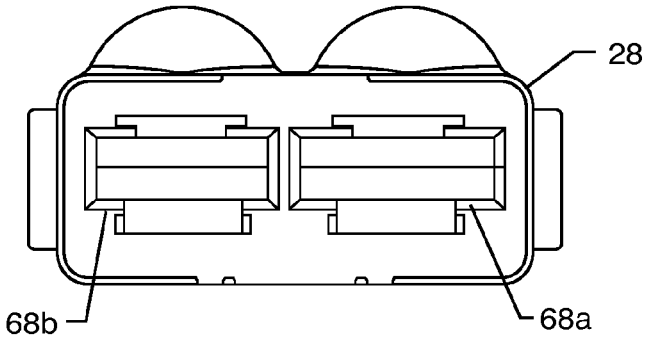
FIG. 13 illustrates a view of the adaptor terminals of the adaptor plug of FIG. 10.
Figure 14:
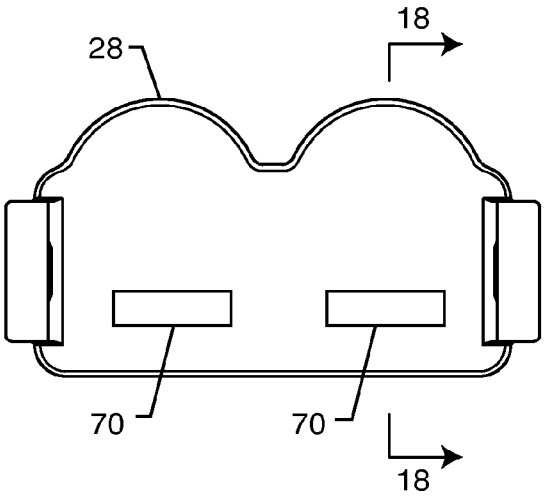
FIG. 14 illustrates a view of the universal contacts of the adaptor plug of FIG. 10.
Figure 15:
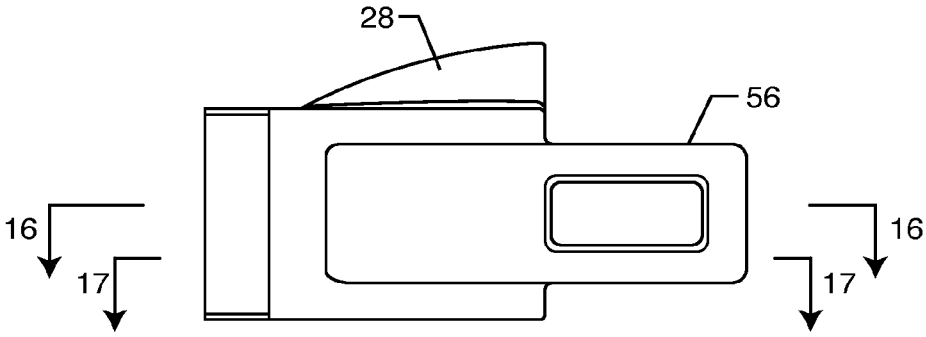
FIG. 15 illustrates a side view of the adaptor plug of FIG. 10.
Figure 16:
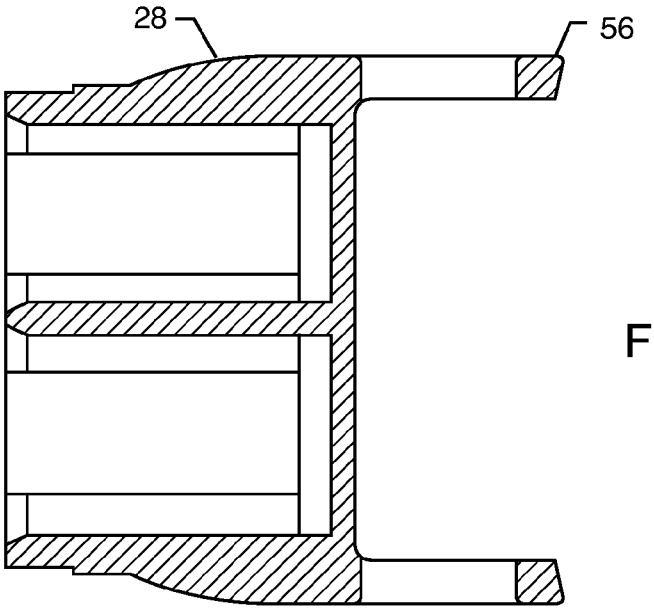
FIG. 16 illustrates a cross-section along line 16-16 of FIG. 15.
Figure 17:
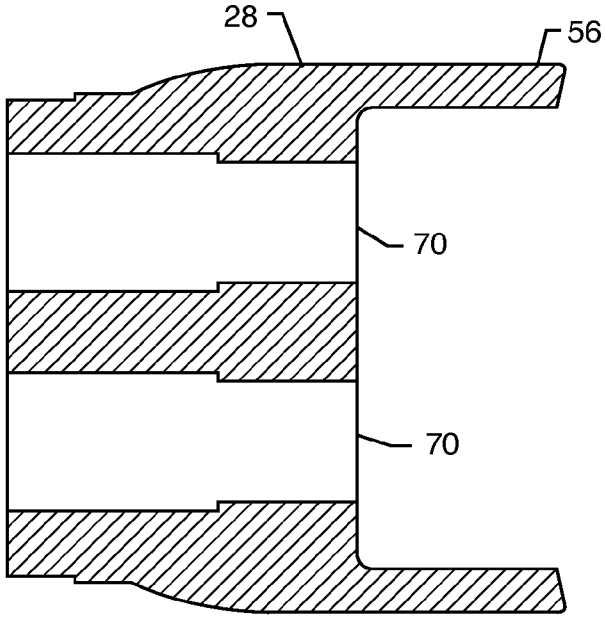
FIG. 17 illustrates a cross-section along line 17-17 of FIG. 15.
Figure 18:
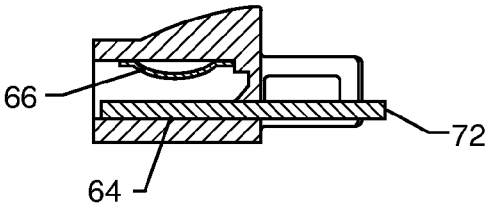
FIG. 18 illustrates a cross-section along line 18-18 of FIG. 14.

In accordance with the present invention, and as shown in FIGS. 1 and 10, the universal battery connector 20 is configured for connection to multiple different battery connection plugs 22, 24. FIG. 1 illustrates the universal battery connection plug 20 coupled to a Molex® brand battery connection plug 22. FIG. 10 illustrates the universal battery connector 20 engaged with a Traxxas® brand battery connection plug 24. As discussed above, the Molex® brand battery connection plug 22 has a particular configuration that is incompatible with the Traxxas® brand battery connection plug 24. Accordingly, the present invention of a universal battery connector 20 was conceived so as to provide a battery 21 for an R/C device which is compatible with either a Molex® brand battery connection plug 22 or a Traxxas® brand battery connection plug 24.

Figure 3:
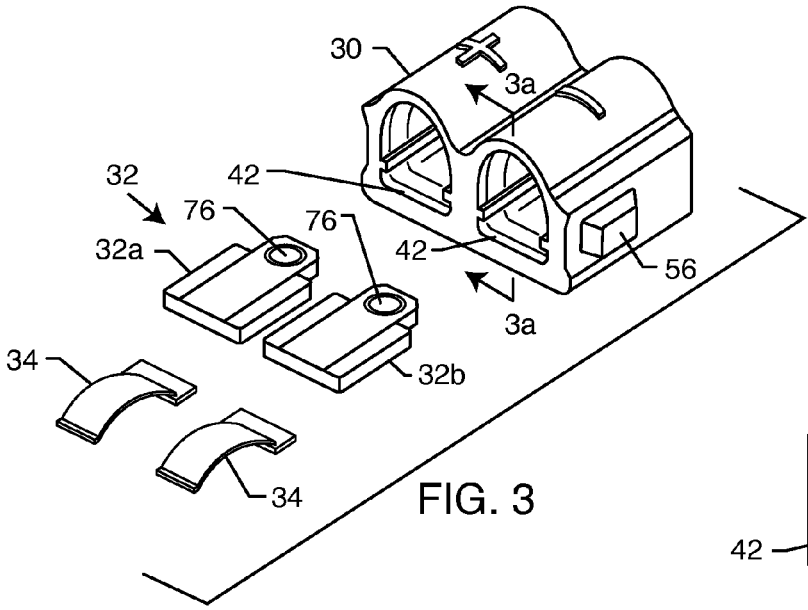
FIG. 3 illustrates an exploded view of the universal battery plug from FIG. 1.

FIGS. 1-9 illustrate the universal battery connector 20 which is compatible with a Molex® brand battery connection plug 22. In this embodiment, the universal battery connector 20 comprises a universal battery plug 26 and an adaptor plug 28. The universal battery plug 26 includes a housing which encloses a universal terminal 32. As illustrated in FIG. 3, the universal terminal 32 preferably comprises positive 32*a* and negative 32*b* terminals which are positioned within the housing 30. Biasing springs 34 are positioned beneath the universal terminals 32. The function of the biasing springs 34 will be described more fully below.

The adaptor plug 28 includes an adaptor housing 36 which encloses adaptor terminals 38. The adaptor terminals preferably comprise positive 38*a* and negative 38*b* terminals. Universal contacts 40 which preferably include positive 40*a* and negative 40*b* are partially enclosed by the housing 36. The universal contacts 40 are in physical contact with the adaptor terminals 38 such that there is electrical communication therebetween.

Figure 3A:
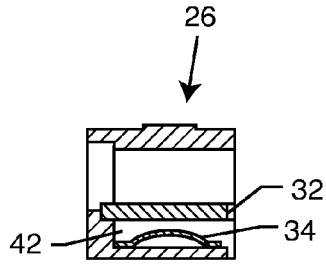
FIG. 3A illustrates a cross-sectional view of the assembled universal battery plug taken along line 3A-3A of FIG. 3.
Figure 4:
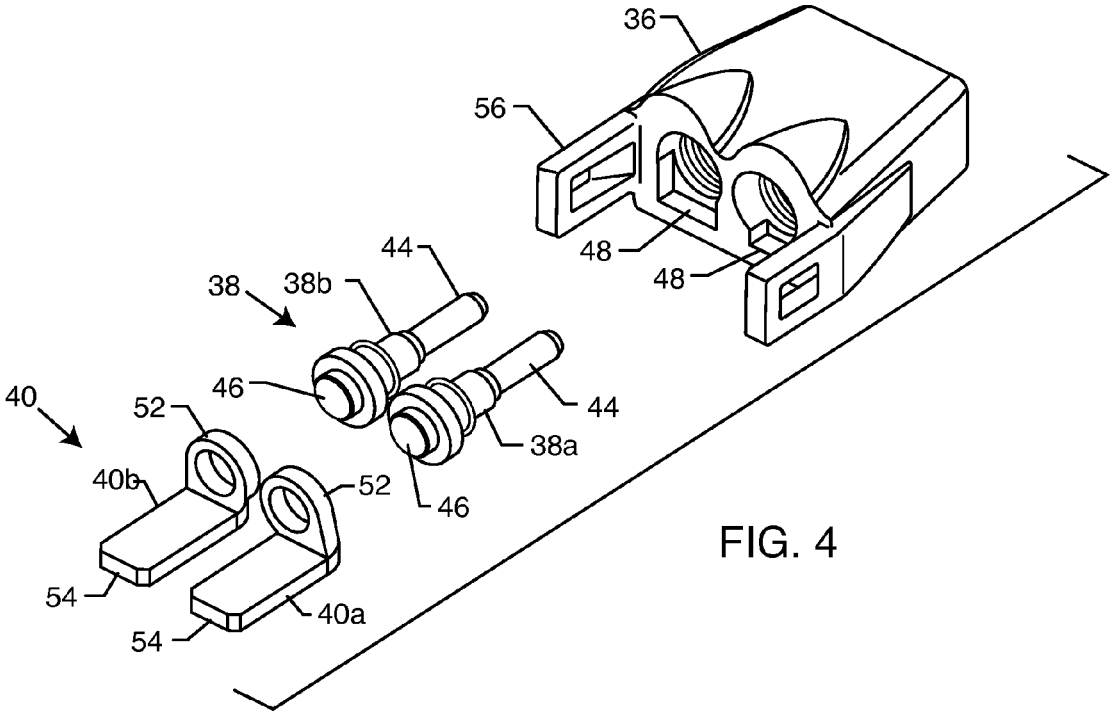
FIG. 4 illustrates an exploded view of the adaptor plug from FIG. 1.
Figure 5:
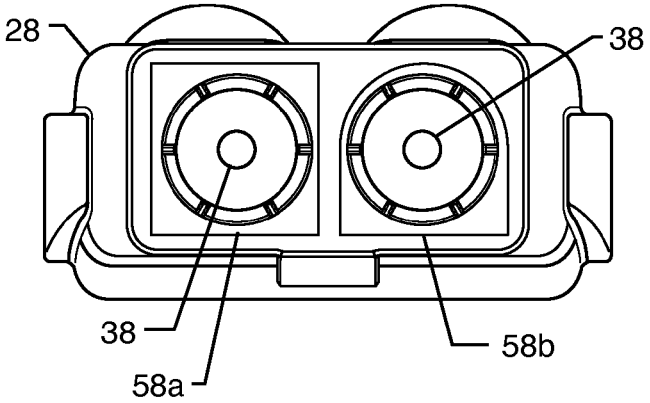
FIG. 5 illustrates a view of the adaptor terminals on the adaptor plug of FIG. 1.
Figure 6:
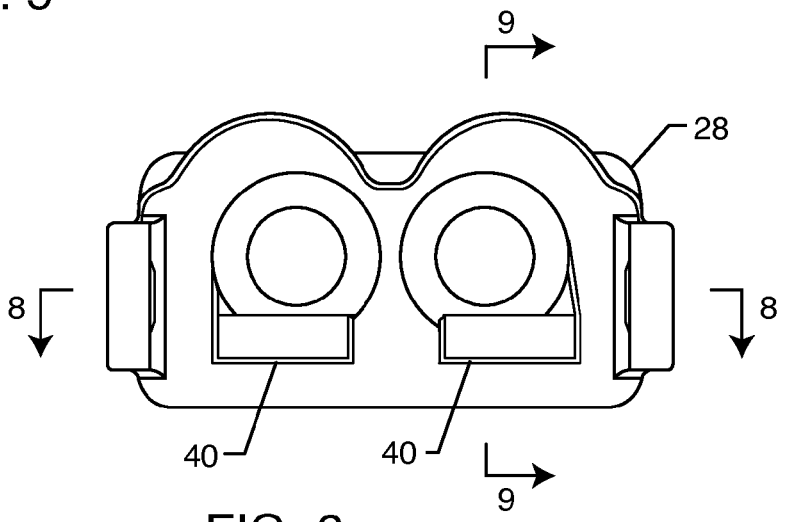
FIG. 6 illustrates a view of the universal contacts on the adaptor plug of FIG. 1.
Figure 7:
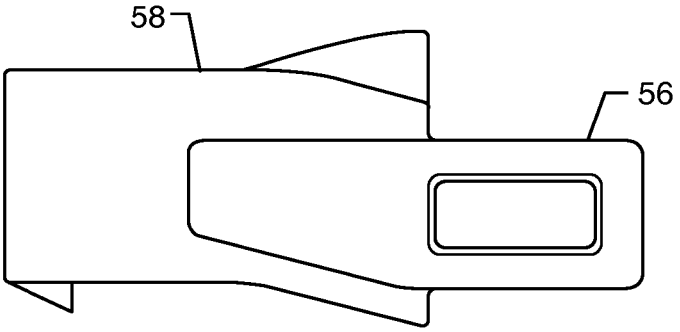
FIG. 7 illustrates a side view of the adaptor plug of FIG. 1.
Figure 8:
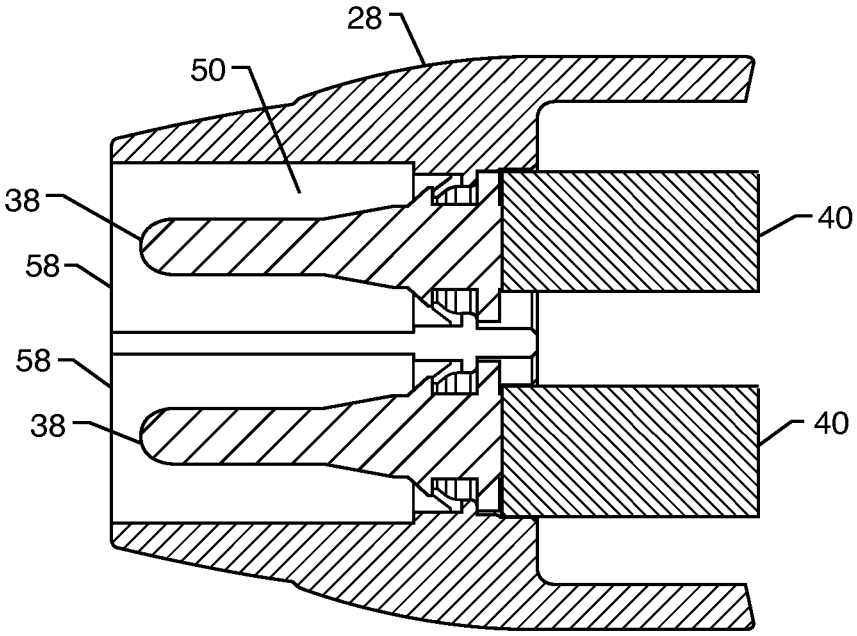
FIG. 8 is a cross-section taken along line 8-8 of FIG. 6.
Figure 9:
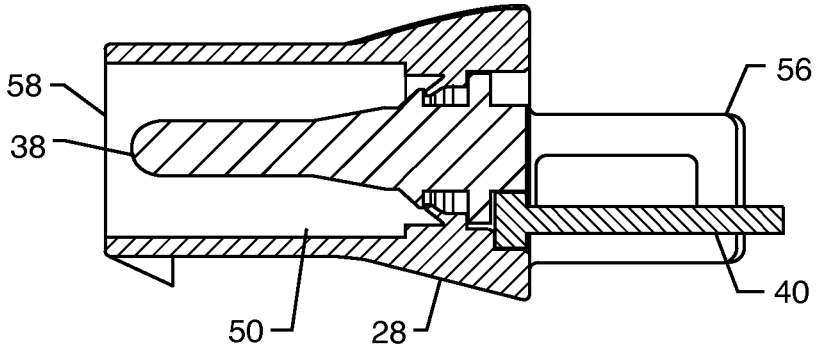
FIG. 9 is a cross-section taken along line 9-9 of FIG. 6.

The adaptor housing 36 and universal battery plug housing 30 are configured for cooperative engagement. The universal contacts 40 are configured to engage slots 42 in the end of the universal battery plug housing 30. The slots 42 position the universal contacts 40 between the universal terminals 32 and the terminal springs 34. The slots 42 and the space between the universal terminals 32 and terminal springs 34 are illustrated more clearly in FIG. 3*a*. When a universal contact 40 enters the slot 42 the terminal spring 34 exerts a force which pushes the universal contact 40 into physical contact with the universal terminal 32. This physical contact results in electrical communication between the two elements.

FIGS. 4-9 detail the construction of the adaptor housing 36 and its related components. The adaptor terminals 38 have elongated bodies 44 with a mounting post 46 at one end thereof. The mounting posts 46 are positioned in contact openings 48 on the adaptor housing 36 such that the elongated bodies 44 extend through a cavity 50 on the adaptor housing 36. The universal contacts 40 include mounting rings 52 which are configured to be positioned in the contact openings 48 and engage the mounting posts 46 on the adaptor terminals 38. The connection between the mounting rings 52 and mounting posts 46 may be secured by solder or any other common method of securing an electrical connection. The universal contacts 44 include contact legs 54 which are configured to engage slots 42 as described above.

The universal battery plug housing 30 and adaptor housing 36 include tab lock connectors 56 for securing the two housings together when they are cooperatively engaged. Other commonly used methods of securing two housings together may be utilized to achieve the same purpose.

The adaptor housing 36 further includes terminal openings 58 on a surface opposite from the contact openings 48. The terminal openings 58 are configured to receive electrically conductive contacts 60 from a Molex® brand battery connection plug 22. In a Molex® brand battery connection plug 22 the electrically conductive contacts 60 both have a female configuration one with a square cross-section 60*a* and the other with a semicircular cross-section 60*b*. The electrically conductive contacts fit into matching square 58*a* and semicircular 58*b* terminal openings on the adaptor housing 36. When the Molex® brand battery connection plug 22 is slide-fit into the adaptor housing 36 the female electrically conductive contacts 60 engage the mounting posts 46 on the male adaptor terminals 38. Because of the particular shapes of the electrically conductive contacts 60 and terminal openings 58 one is assured of making the connection with the proper polarity.

FIGS. 10-18 illustrate an alternate embodiment of the universal battery connector 20 which is compatible with a Traxxas® brand battery connection plug 24. In this embodiment, the universal battery plug 26 is identical to that described above for the embodiment compatible with a Molex® brand battery connection plug 22. The difference in construction resides in the adaptor plug 28.

In this embodiment, as depicted in FIGS. 11-18, the adaptor plug 28 includes an adaptor housing 62 which encloses adaptor terminals 64 that have positive 64*a* and negative 64*b* terminals. Adaptor springs 66 are positioned above the adaptor terminals 64.

The adaptor terminals 64 are generally elongated bodies which pass through the adaptor housing from terminal openings 68 on one end to contact openings 70 on an opposite end. The adaptor terminals 64 extend through the contact openings 70 such that a portion of the adaptor terminals comprise universal contacts 72 which include positive 72*a* and negative 72*b* contacts. These universal contacts 72 engage the slots 42 on the universal battery plug 26 as with universal contacts 40 described above. The adaptor housing 62 includes mating tab lock connectors 56 to retain the adaptor plug 28 in cooperative engagement with the universal battery plug 26.

One face of the adaptor plug 28 includes terminal openings 68 which function in a manner similar to that described above for the terminal openings 58 of the prior embodiment. In the current embodiment, the terminal openings 68 comprise generally rectangular openings to accommodate the adaptor terminals 64. The terminal openings 68 have slightly varying sizes, i.e., wide 68*a* and narrow 68*b*, such that the Traxxas® brand battery connection plug 24 may only engage the adaptor plug 28 in one direction. The electrically conductive contacts 74 have slightly varying sizes, i.e., wide 74*a* and narrow 74*b*, to match the terminal openings 68. This assures that the correct polarity is achieved with each installation.

When the Traxxas® brand battery connection plug 24 is slide-fitted into the adapted plug 28, electrically conductive contacts 74 are positioned between the adaptor terminals 64 and the adaptor springs 66. The biasing action of the adaptor springs 66 forces the electrically conductive contacts 74 into physical contact with the adaptor terminals 64. In this way, electrical connection is achieved between the electrically conductive contacts 74 and the adaptor terminals 64.

Thus, a retail store need only carry one type of battery, the universal battery plug 26 and the two embodiments of the adaptor plug 28. Similarly, a consumer need only purchase one type of battery, the universal battery plug 26 and each type of adaptor plug 28. In this way, the battery may be connected to an R/C device regardless of whether it has a Molex® brand battery connection plug 22 or a Traxxas® brand battery connection plug 24. One need only switch the type of adaptor plug 28 which is used to accommodate either brand with a single battery and universal battery plug 26.

The universal battery plug 26 includes battery contacts 76 which are configured to receive positive and negative terminals from a battery (not shown). The battery contacts 76 are in electrical communication with the universal terminals 32 and are preferably part of the universal terminal 32.

Figure 19:
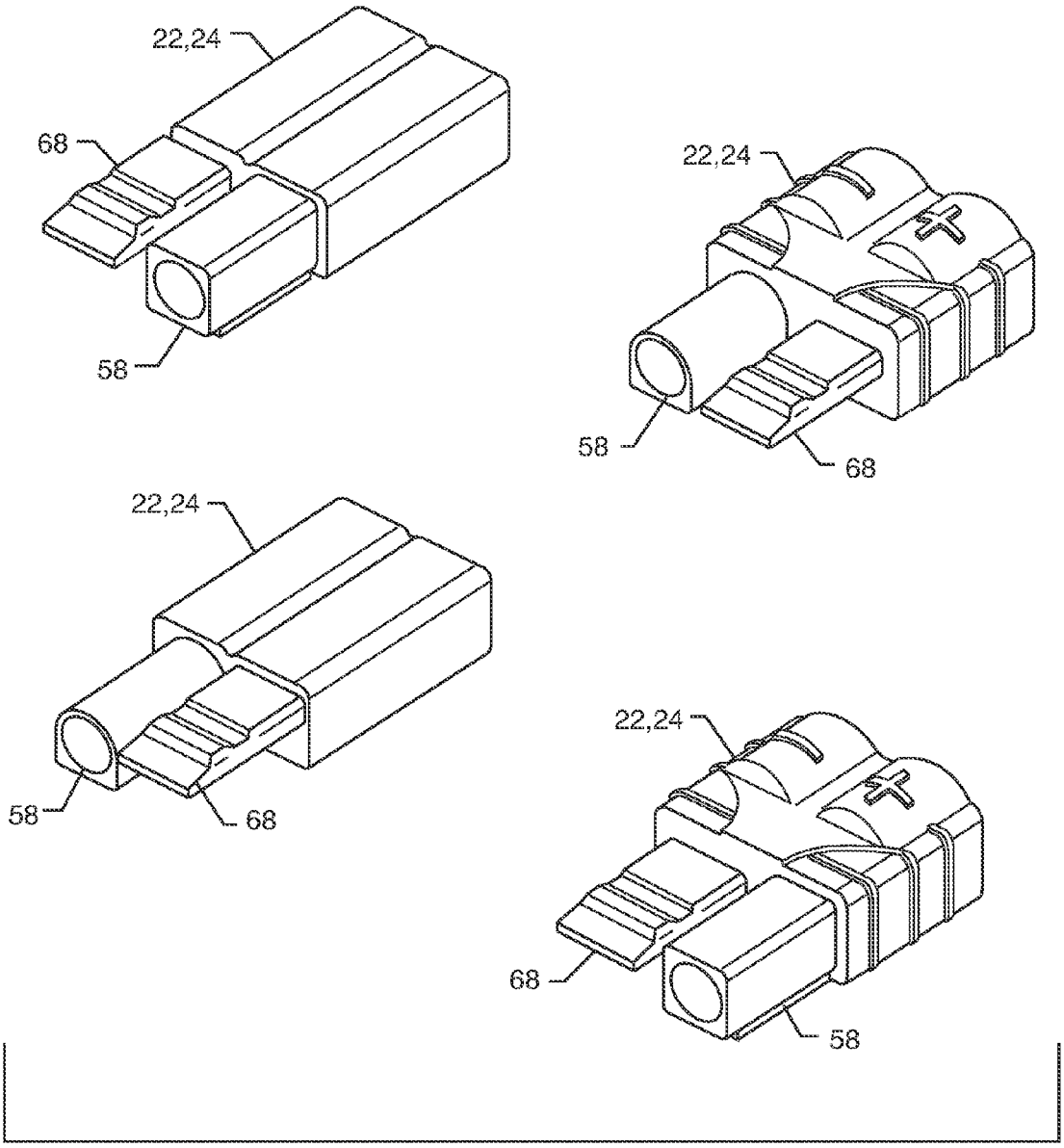
FIG. 19 illustrates various forms of battery connection plugs having various combinations of male and female electrically conductive contacts.
Figure 20:
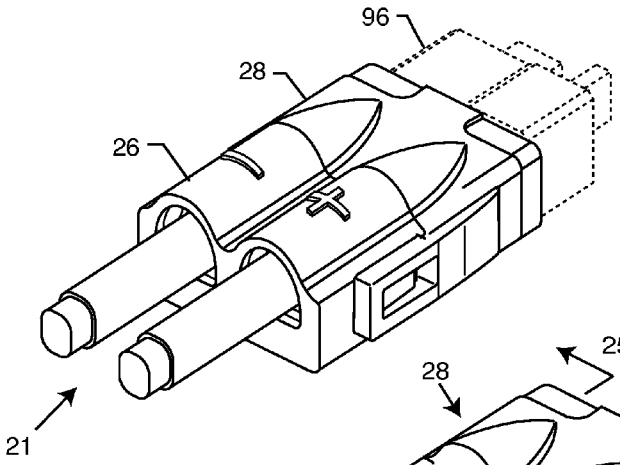
FIG. 20 illustrates another embodiment of the universal battery connector of the present invention.
Figure 21:
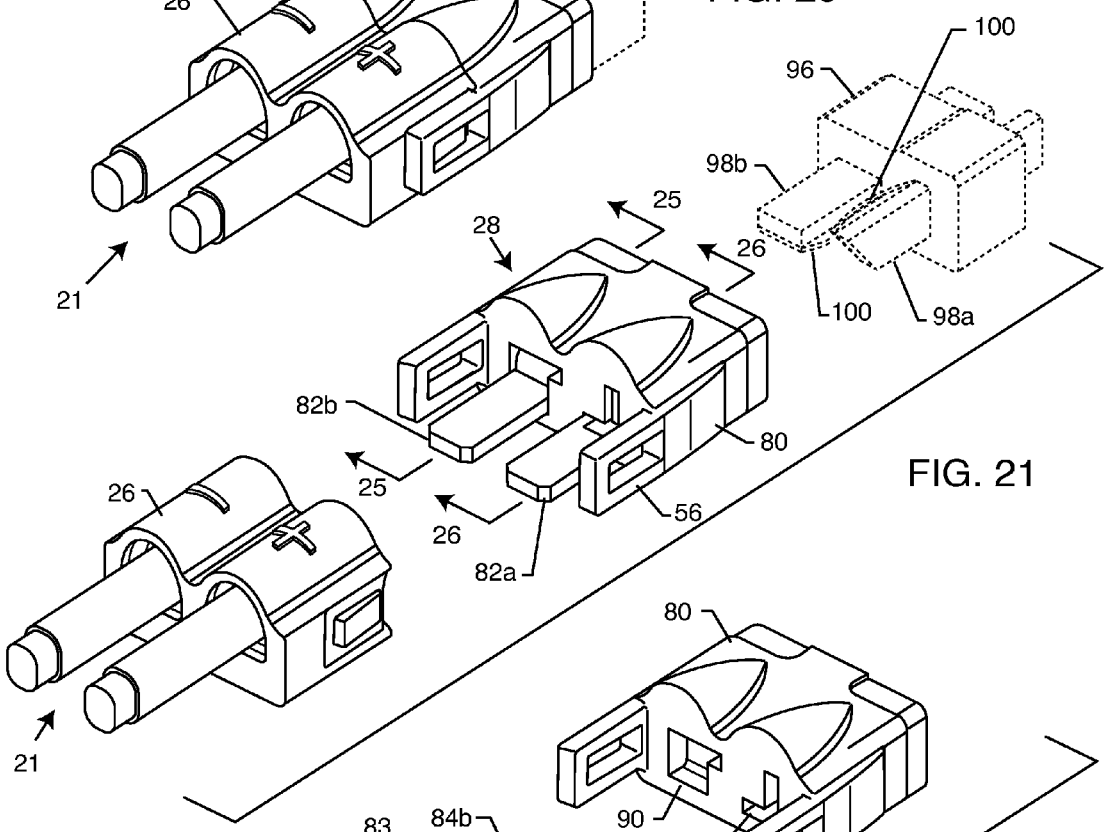
FIG. 21 illustrates an exploded view of the universal battery connector of FIG. 20.
Figure 22:
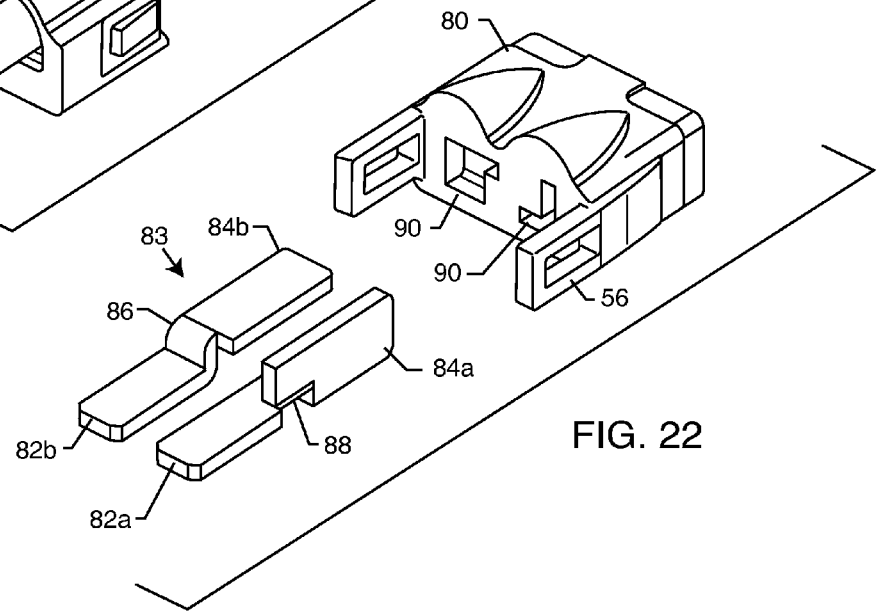
FIG. 22 illustrates an exploded view of the adaptor plug from FIG. 20.
Figure 23:
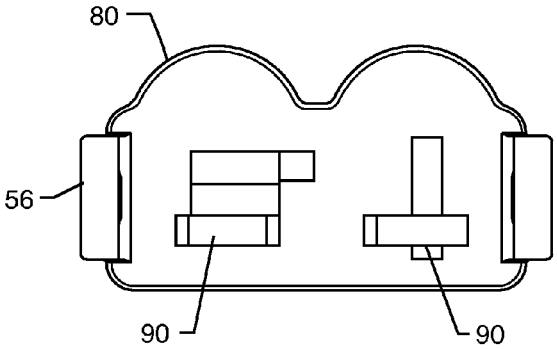
FIG. 23 illustrates the universal contacts of the adaptor plug of FIG. 20.
Figure 24:
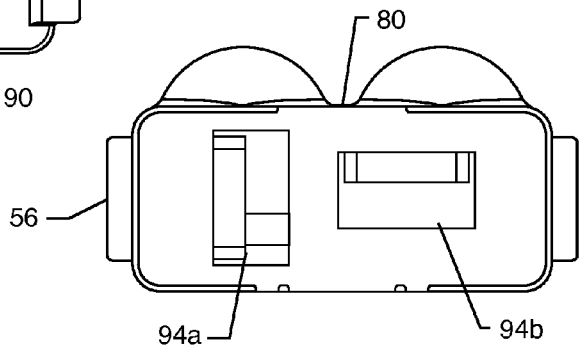
FIG. 24 illustrates a view of the adaptor terminals of the adaptor plug of FIG. 20.
Figure 25:
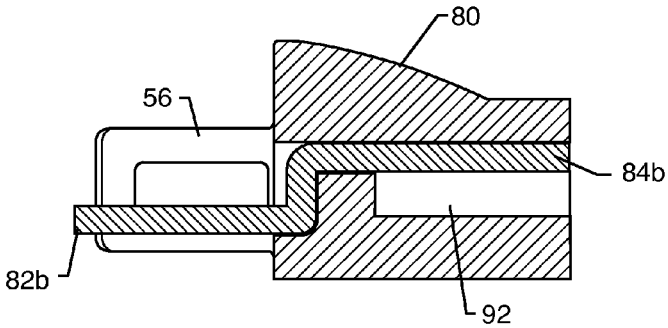
FIG. 25 illustrates a cross-section along line 25-25 of FIG. 21.
Figure 26:
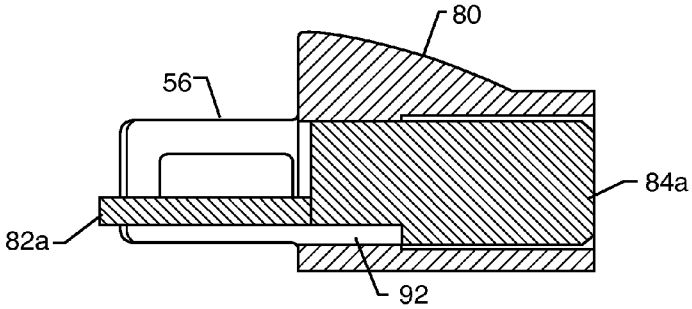
FIG. 26 illustrates a cross-section along line 26-26 of FIG. 21.

In yet another alternate embodiment, the adaptor plug 28 may have terminal openings 58, 68 that can accommodate a combination of male and female electrically conductive contacts 60 on a battery connection plug 22, 24. As illustrated in FIG. 19, it is contemplated that alternate forms of the battery connection plugs 22, 24 can be presented with a combination of male and female electrically conductive contacts 60. To accommodate these combinations of male and female electrically conductive contacts 60 the adaptor plug 28 accordingly has combinations of terminal openings 58, 68 and adaptor terminals 38, 64 to accommodate the appropriate male and female electrically conductive contacts 60. A person of ordinary skill in the art will understand the appropriate combinations of universal contacts 40, adaptor terminals 38, 64 and terminal openings 58, 68 to be compatible with the combination male and female electrically conductive contacts 60.

FIGS. 20-26 illustrate an alternate embodiment of the present invention. In this embodiment, the adaptor plug 28 comprises adaptor housing 80 and universal contacts 82. The universal contacts include positive 82*a* and negative 82*b* contacts. The adaptor housing 80 also includes tab lock connectors 56. As with prior embodiments, the adaptor housing 80 is configured to engage the universal battery plug 26 through mated engagement of the universal contacts 82 with the slots 42 on the universal battery plug 26.

The universal contacts 82 are one end of elongated members 83 which include adaptor terminals 84 at an opposite second end thereof. One of the elongated members 83 includes a stepped offset 86 such that the universal contact 82*b* is positioned at a different height from the corresponding adaptor terminal 84*b*. The other elongated member 83 has a rotated offset 88 such that the universal contact 82*a* is oriented in a plane having an orthogonal relationship to the plane of the corresponding adaptor terminal 84*a*. The universal contacts 82 extend through contact openings 90 in the adaptor housing 80. The adaptor terminals 84 extend through a cavity 92 in the adaptor housing 80 and are disposed proximate to terminal openings 94 in the adaptor housing 80. The terminal openings 94 have corresponding vertical 94*a* and horizontal 94*b* configurations to match with the orientations of the adaptor terminals 84*a* and 84*b*.

This embodiment of the adaptor plug 28 is configured to engage a battery connection plug 96 as described in U.S. Pat. No. 5,533,915 (Deans). The Deans battery connection plug 96 has two electrically conductive contacts 98. One of these contacts 98*a* has a vertical orientation, whereas the other of these contacts 98*b* has a horizontal orientation. Both of these contacts 98 have a male configuration. The contacts 98 engage the terminal openings 94 on the face of the adaptor housing 80. These electrically conductive contacts 98 include biasing springs 100 to assure that the contacts 98 come into electrical contact with the adaptor terminals 84 upon insertion into the terminal openings 94. The vertical 98*a* and horizontal 98*b* orientations of the contacts 98 are configured to match the vertical 94*a* and horizontal 94*b* orientations of the terminal openings 94 on the adaptor housing 80.

Although several embodiments have been described in detail for purposes of illustration, various modifications may be made without departing from the scope and spirit of the invention. Accordingly, the invention is not to be limited, except as by the appended claims.

What is claimed is:

1. A universal battery connector system for radio controlled devices, adaptable for interchangeable use with different types of battery connection plugs having electrically conductive contacts, comprising:

a universal battery plug;

a first adaptor configured for conductively coupling the universal battery plug to electrically conductive contacts on a first type of battery connection plug, wherein the first adaptor includes first adaptor terminals having two generally rectangular terminal openings configured for slide fit reception of the electrically conductive contacts on the first type of battery connection plug and universal contacts configured for connection to the universal battery plug, wherein the electrically conductive contacts on the first type of battery connection plug has first and second generally rectangular electrically conductive male contacts, the first male contact having a first width and the second male contact having a second width narrower than the first width;

a second adaptor configured for conductively coupling the universal battery plug to electrically conductive contacts on a second type of battery connection plug, wherein the second adaptor includes second adaptor terminals having a first terminal opening with a generally square cross-section and the second terminal opening with a generally semi-circular cross-section, both terminal openings configured for slide fit reception of the electrically conductive contacts on the second type of battery connection plug and universal contacts configured for connection to the universal battery plug, wherein the electrically conductive contacts on the second type of battery connection plug has first and second electrically conductive female contacts, the first female contact having a generally square cross-section and the second female contact having a generally semi-circular cross-section; and wherein the universal battery plug is configured to interchangeably connect to either the first adaptor or the second adaptor.

2. The system of claim 1, wherein the first type of battery connection plug is a Traxxas® type battery connection plug.

3. The system of claim 1, wherein the second type of battery connection plug is a Molex® type battery connection plug.

4. The system of claim 1, further comprising a third adaptor configured for conductively coupling the universal battery plug to electrically conductive contacts on a third type of battery connection plug, the third adaptor including third adaptor terminals configured for receipt of the electrically conductive contacts on the third type of battery connection plug and universal contacts configured for connection to the universal battery plug, wherein the universal battery plug is configured to interchangeably connect to the first adaptor, the second adaptor or the third adaptor, and wherein the third adaptor is configured for slide fit reception with the third type of battery connection plug, the third type of battery connection plug having one electrically conductive male contact and one electrically conductive female contact.

5. The system of claim 1, wherein the adaptor terminals comprise positive and negative adaptor terminals and the electrically conductive contacts comprise positive and negative electrically conductive contacts, such that the positive and negative electrically conductive contacts are in electrical communication with the corresponding positive and negative adaptor terminals.

6. The system of claim 1, wherein the universal battery plug comprises positive and negative universal terminals configured for connection to the universal contacts on the first and second adaptors.

7. The system of claim 6, wherein the universal battery plug includes battery contacts on the universal terminals, wherein the battery contacts are configured to receive positive and negative battery terminals from a battery.

8. A universal battery connector system for radio controlled devices, adaptable for interchangeable use with different types of battery connection plugs having electrically conductive contacts, comprising:

a universal battery plug;

a first adaptor configured for conductively coupling the universal battery plug to two electrically conductive male contacts on a first type of battery connection plug, wherein the first adaptor includes first adaptor terminals having two generally rectangular terminal openings configured for slide fit reception of the electrically conductive contacts on the first type of battery connection plug and universal contacts configured for connection to the universal battery plug, wherein the two electrically conductive male contacts on the first type of battery connection plug comprise first and second generally rectangular male contacts, the first male contact having a first width and the second male contact having a second width narrower than the first width;

a second adaptor configured for conductively coupling the universal battery plug to two electrically conductive female contacts on a second type of battery connection plug, wherein the second adaptor includes second adaptor terminals having a first terminal opening with a generally square cross-section and second terminal opening with a generally circular cross-section, both terminal openings configured for slide fit reception of the electrically conductive contacts on the second type of battery connection plug and universal contacts configured for connection to the universal battery plug, wherein the two electrically conductive female contacts on the second type of battery connection plug comprise first and second female contacts, the first female contact having a generally square cross-section and the second female contact having a generally semi-circular cross-section; and wherein the universal battery plug is configured to interchangeably connect to either the first adaptor or the second adaptor.

9. The system of claim 8, wherein the first type of battery connection plug is a Traxxas® type battery, connection plug.

10. The system of claim 8, wherein the second type of battery connection plug is a Molex® type battery connection plug.

11. The system of claim 8, further comprising a third adaptor configured for conductively coupling the universal battery plug to electrically conductive contacts on a third type of battery connection plug, the third type of battery connection plug having one electrically conductive male contact and one electrically conductive female contact, the third adaptor including third adaptor terminals configured for receipt of the electrically conductive male and female contacts and universal contacts configured for connection to the universal battery plug, wherein the universal battery plug is configured to interchangeably connect to the first adaptor, the second adaptor or the third adaptor, and wherein the third adaptor is further configured for slide fit reception with the third type of battery connection plug.

12. The system of claim 8, wherein the adaptor terminals comprise positive and negative adaptor terminals and the electrically conductive contacts comprise positive and negative electrically conductive contacts, such that the positive and negative electrically conductive contacts are in electrical communication with the corresponding positive and negative adaptor terminals.

13. The system of claim 8, wherein the universal battery plug comprises positive and negative universal terminals configured for connection to the universal contacts on the first and second adaptors.

14. The system of claim 13, wherein the universal battery plug includes battery contacts on the universal terminals, wherein the battery contacts are configured to receive positive and negative battery terminals from a battery.

15. A universal battery connector system for radio controlled devices, adaptable for interchangeable use with different types of battery connection plugs having electrically conductive contacts, comprising:

a universal battery plug;

a first adaptor configured for conductively coupling the universal battery plug to two electrically conductive male contacts on a Traxxas® type battery connection plug, wherein the two electrically conductive male contacts comprise first and second generally rectangular male contacts, the first male contact having a first width and the second male contact having a second width narrower than the first width, the first adaptor further configured for slide fit reception with the Traxxas® type battery connection plug, wherein the first adaptor includes first adaptor terminals having two generally rectangular terminal openings configured for receipt of the electrically conductive male contacts on the Traxxas® type battery connection plug and universal contacts configured for connection to the universal battery plug;

a second adaptor configured for conductively coupling the universal battery plug to two electrically conductive female contacts on a Molex® type battery connection plug, wherein the female contacts comprise first and second female contacts, the first female contact having a generally square cross-section and the second female contact having a generally semi-circular cross-section, the second adaptor further configured for slide fit reception with the Molex® type battery connection plug, wherein the second adaptor includes second adaptor terminals having a first terminal opening with a generally square cross-section and a second terminal opening with a generally semi-circular cross-section, both terminal openings configured for receipt of the electrically conductive female contacts on the Molex® type battery connection plug and universal contacts configured for connection to the universal battery plug; and wherein the universal battery plug is configured to interchangeably connect to either the first adaptor or the second adaptor.

16. The system of claim 15, further comprising a third type of adaptor configured for conductively coupling the universal battery plug to electrically conductive contacts on a third type of battery connection plug, the third battery connection plug having one electrically conductive male contact and one electrically conductive female contact, the third adaptor including third adaptor terminals configured for receipt of the electrically conductive male and female contacts and universal contacts configured for connection to the universal battery plug, wherein the universal battery plug is configured to interchangeably connect to the first adaptor, the second adaptor or the third adaptor, and wherein the third adaptor is further configured for slide fit reception with the third type of battery connection plug.

17. The system of claim 15, wherein the universal battery plug comprises positive and negative universal terminals configured for connection to the universal contacts on the first and second adaptors, and the universal battery plug includes battery contacts on the universal terminals, wherein the battery contacts are configured to receive positive and negative battery terminals from a battery.

18. The system of claim 15, wherein the adaptor terminals comprise positive and negative adaptor terminals and the electrically conductive contacts comprise positive and negative electrically conductive contacts, such that the positive and negative electrically conductive contacts are in electrical communication with the corresponding positive and negative adaptor terminals.

* * * * *